US011810417B2

(12) United States Patent
Ikeda et al.

(10) Patent No.: US 11,810,417 B2
(45) Date of Patent: Nov. 7, 2023

(54) PAPER SHEET STORAGE DEVICE AND CONTROL METHOD OF PAPER SHEET STORAGE DEVICE

(71) Applicant: FUJITSU FRONTECH LIMITED, Tokyo (JP)

(72) Inventors: Naoto Ikeda, Inagi (JP); Yuji Tanaka, Inagi (JP); Mitsutaka Nishida, Inagi (JP)

(73) Assignee: FUJITSU FRONTECH LIMITED, Tokyo (JP)

( * ) Notice: Subject to any disclaimer, the term of this patent is extended or adjusted under 35 U.S.C. 154(b) by 679 days.

(21) Appl. No.: 16/933,151

(22) Filed: Jul. 20, 2020

(65) Prior Publication Data

US 2020/0349793 A1 Nov. 5, 2020

Related U.S. Application Data

(63) Continuation of application No. PCT/JP2018/002910, filed on Jan. 30, 2018.

(51) Int. Cl.
*B65H 29/58* (2006.01)
*G07D 11/22* (2019.01)
(Continued)

(52) U.S. Cl.
CPC ..... *G07D 11/22* (2019.01); *G07D 11/12* (2019.01); *G07D 11/16* (2019.01); *B65H 29/58* (2013.01)

(58) Field of Classification Search
CPC ..... G07D 11/22; G07D 11/12; G07D 11/16; G07D 11/18; B65H 29/58
See application file for complete search history.

(56) References Cited

U.S. PATENT DOCUMENTS 8,167,304 B2 * 5/2012 Fukazawa ..... B65H 29/58 271/225
8,991,824 B2 * 3/2015 Suzuki ..... B65H 85/00 271/301
(Continued)

FOREIGN PATENT DOCUMENTS

JP 9-235061 9/1997
JP 2000-103544 4/2000
(Continued)

OTHER PUBLICATIONS

Examination Report, dated May 10, 2021, in corresponding Indian Application No. 202037029913 (5 pp.).
(Continued)

*Primary Examiner* — Howard J Sanders
(74) *Attorney, Agent, or Firm* — STAAS & HALSEY LLP

(57) ABSTRACT

A paper sheet storage device includes a storage unit, a conveyance mechanism including a carry-in path and a carry-out path, a gate member switched between a storage state and a passing state, a lock mechanism including a lock member which restricts a movement of the gate member, and an unlock member that unlocks a locked state. The unlock member is disposed so as to project from a side of one of the carry-in path and the carry-out path to outside of the paper sheet storage device. The lock member is disposed so as to project from a side of the other of the carry-in path and the carry-out path to the outside of the paper sheet storage device. When the paper sheet storage device is connected to another paper sheet storage device, the lock member is moved by the unlock member of the another paper sheet storage device.

6 Claims, 13 Drawing Sheets

(51) Int. Cl.
*G07D 11/12* (2019.01)
*G07D 11/16* (2019.01)

(56) References Cited

U.S. PATENT DOCUMENTS

| | | | | |
|---|---|---|---|---|
| 9,886,825 | B2 * | 2/2018 | Kawabata | G06F 12/14 |
| 10,127,757 | B2 * | 11/2018 | Kim | B65H 29/60 |
| 11,034,540 | B2 * | 6/2021 | Miyauchi | B65H 85/00 |
| 2002/0180136 | A1 | 12/2002 | Amari et al. | |
| 2013/0156479 | A1 * | 6/2013 | Nara | G03G 15/6552 271/225 |
| 2015/0243119 | A1 * | 8/2015 | Hayashi | G07D 11/14 194/206 |

FOREIGN PATENT DOCUMENTS

| | | |
|---|---|---|
| JP | 2002-150356 | 5/2002 |
| JP | 2003-176073 | 6/2003 |
| JP | 2005-353103 | 12/2005 |
| JP | 2016-81289 | 5/2016 |

OTHER PUBLICATIONS

International Search Report dated Apr. 10, 2018 in corresponding International Application No. PCT/JP2018/002910.

* cited by examiner

PAPER SHEET STORAGE DEVICE AND CONTROL METHOD OF PAPER SHEET STORAGE DEVICE

CROSS-REFERENCE TO RELATED APPLICATION

This application is a continuation application of International Application PCT/JP2018/002910, filed on Jan. 30, 2018 and designating the U.S., the entire contents of which are incorporated herein by reference.

FIELD

The present invention relates to a paper sheet storage device and a control method of the paper sheet storage device.

BACKGROUND

For example, automatic teller machines include a banknote storage device that stores banknotes as paper sheets. This type of the banknote storage device has a conveyance mechanism that conveys banknotes, and a storage unit that stores banknotes conveyed by the conveyance mechanism, and it is configured that a plurality of the banknote storage devices are connected to each other via the conveyance mechanisms. This banknote storage device includes a gate member that is switched between a storage state, where the banknotes conveyed by the conveyance mechanism are stored in the storage unit, and a passing state, where the banknotes sent by the conveyance mechanism are sent to another banknote storage device.

Patent Literature 1: Japanese Laid-open Patent Publication No. 2005-353103

When conveyance mechanisms of the banknote storage devices described above are connected, if the control of a switching operation of a gate member malfunctions or the switching mechanism of the gate member breaks down in a banknote storage device, which is arranged at a terminal end in a direction of conveying banknotes between the banknote storage devices, there is a problem that a banknote may pass through a conveyance path of the banknote storage device by mistake. At this time, for example, when the terminal end of the conveyance path in the banknote storage device, which is arranged at the terminal end, is open to outside, there is a possibility that a banknote, which is discharged from the conveyance path, may be lost.

SUMMARY

According to an aspect of the embodiments, a paper sheet storage device includes: a storage unit that stores a paper sheet; a conveyance mechanism that includes a carry-in path for sending a paper sheet to the storage unit and a carry-out path for sending a paper sheet from the carry-in path; a gate member that is disposed in the conveyance mechanism and is switched between a storage state, where a paper sheet is sent from the carry-in path to the storage unit, and a passing state, where a paper sheet is sent from the carry-in path to the carry-out path; a lock mechanism that includes a lock member which is moved between a locked state, where a movement of the gate member is restricted, and an unlocked state, where the locked state is unlocked; and an unlock member that unlocks a locked state, where the lock member restricts a movement of the gate member, wherein the unlock member is disposed so as to project from a side of one of the carry-in path and the carry-out path to outside of the paper sheet storage device, the lock member is disposed so as to project from a side of an other of the carry-in path and the carry-out path to the outside of the paper sheet storage device, and when the conveyance mechanism of the paper sheet storage device is connected to the conveyance mechanism of another paper sheet storage device that is different from the paper sheet storage device, the lock member is moved by the unlock member of the another paper sheet storage device.

The object and advantages of the invention will be realized and attained by means of the elements and combinations particularly pointed out in the claims.

It is to be understood that both the foregoing general description and the following detailed description are exemplary and explanatory and are not restrictive of the invention.

DESCRIPTION OF EMBODIMENTS

Hereinafter, embodiments of a paper sheet storage device and a control method of the paper sheet storage device disclosed in the present application, will be described in detail with reference to the drawings. Note that the following embodiments do not limit the paper sheet storage device and the control method of the paper sheet storage device disclosed in the present application.

First Embodiment

[Configuration of Banknote Handling Device]

Figure 1:
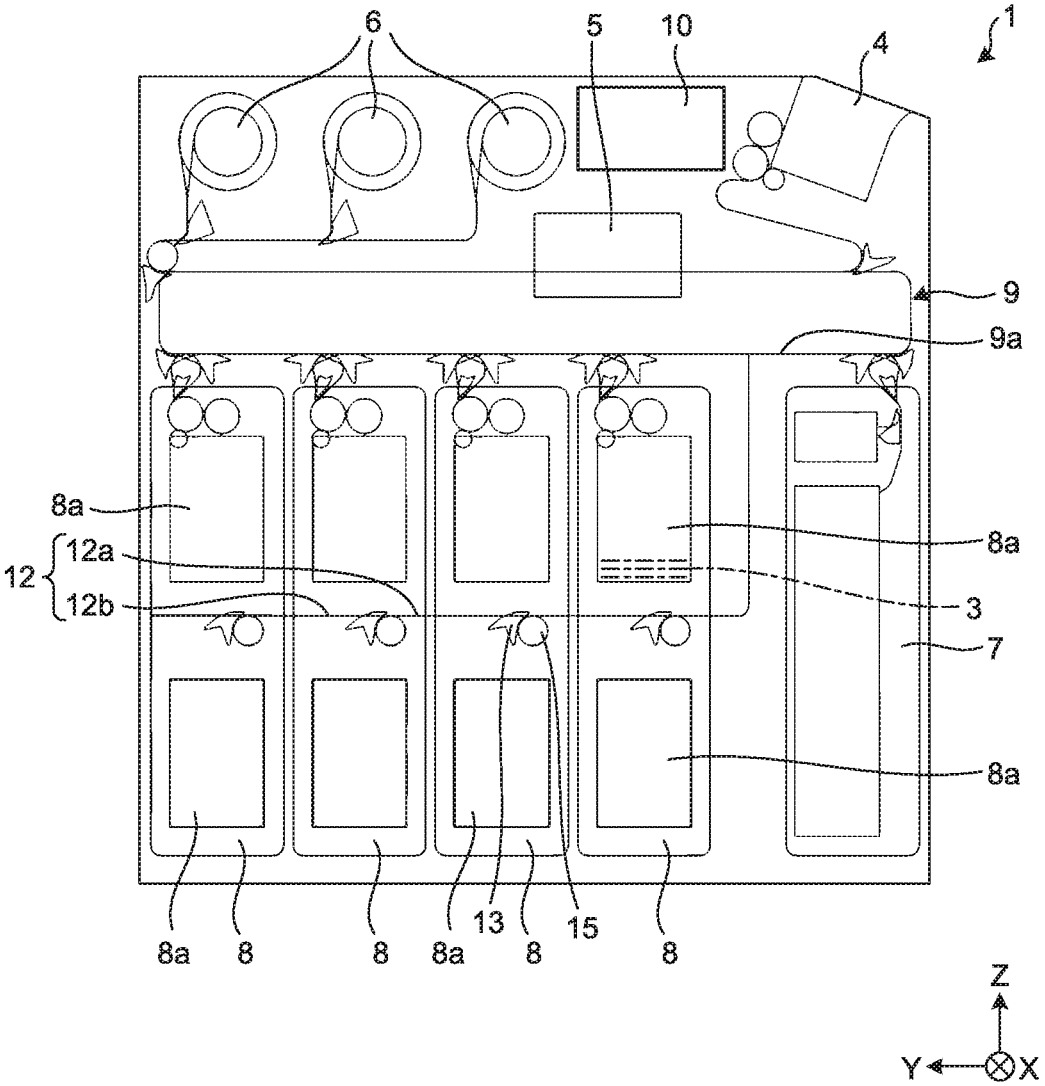
FIG. 1 is a schematic view illustrating an entire banknote handling device of a first embodiment.

FIG. 1 is a schematic view illustrating an entire banknote handling device of a first embodiment. As illustrated in FIG. 1, a banknote handling device 1 according to the first embodiment includes, a depositing and dispensing unit 4 that deposits and dispenses a banknote 3 as a paper sheet, a discrimination unit 5 that discriminates the banknote 3, which are deposited in the depositing and dispensing unit 4, and a temporary storage unit 6 that temporarily stores the banknote 3, which are conveyed from the discrimination unit 5. The banknote handling device 1 also includes, a dispensing unit 7, in which the banknotes 3 to be dispensed to a user, are stored, and a collection unit 8 that stores the banknotes 3, which are sent from the temporary storage unit 6, in a collection box 8*a*. In addition, the banknote handling device 1 includes, a conveyance mechanism 9 that conveys the banknote 3 between the units 4, 5, 6, 7, and 8 along a conveyance path 9*a*, and a controller 10 that controls the units 4, 5, 6, 7, 8, and 9, respectively.

For convenience of description, in FIG. 1, the width direction of the banknote handling device 1 is referred to as "X direction", the front-back direction of the banknote handling device 1 is referred to as "Y direction", and the up-down direction of the banknote handling device 1 is referred to as "Z direction". In subsequent drawings, the X, Y, and Z directions are respectively indicated as in FIG. 1.

As illustrated in FIG. 1, the collection unit 8, which is incorporated in the banknote handling device 1, corresponds to a banknote storage device of the first embodiment. Hereinafter, the collection unit 8 will be described as a banknote storage device 8, and the collection box 8*a* will be described as a storage unit 8*a*. In the banknote handling device 1, the number of the banknote storage devices 8 to be used is changed as needed. For example, the banknote storage device 8 is added as the saying is by further connecting an additional banknote storage device 8 to a terminal end (most downstream side) in a conveyance direction between a plurality of banknote storage devices 8 connected to each other. Similarly, in the banknote handling device 1, by removing the banknote storage device 8, which is arranged at the terminal end of a group of the banknote storage devices 8 that are connected to each other, for example, the banknote storage device 8 at the terminal end is changed. A plurality of types of banknotes 3 are respectively stored in the banknote storage devices 8, for example.

As illustrated in FIG. 1, in the banknote storage device 8, two storage units (collection boxes) 8*a* are arranged side by side in the up-down direction (Z direction). In the banknote storage device 8, the number and arrangement of the storage units 8*a* are not limited, and the configuration, in which the banknote storage device 8 has one storage unit 8*a*, may be applied. In the present embodiment, the banknote 3 is used as an example of a paper sheet, but the present invention is not limited to the banknote 3. The paper sheets include, for example, banknotes, checks, gift certificates, various securities, and securities such as stock certificates.

[Configuration of Banknote Storage Device]

Figure 2:
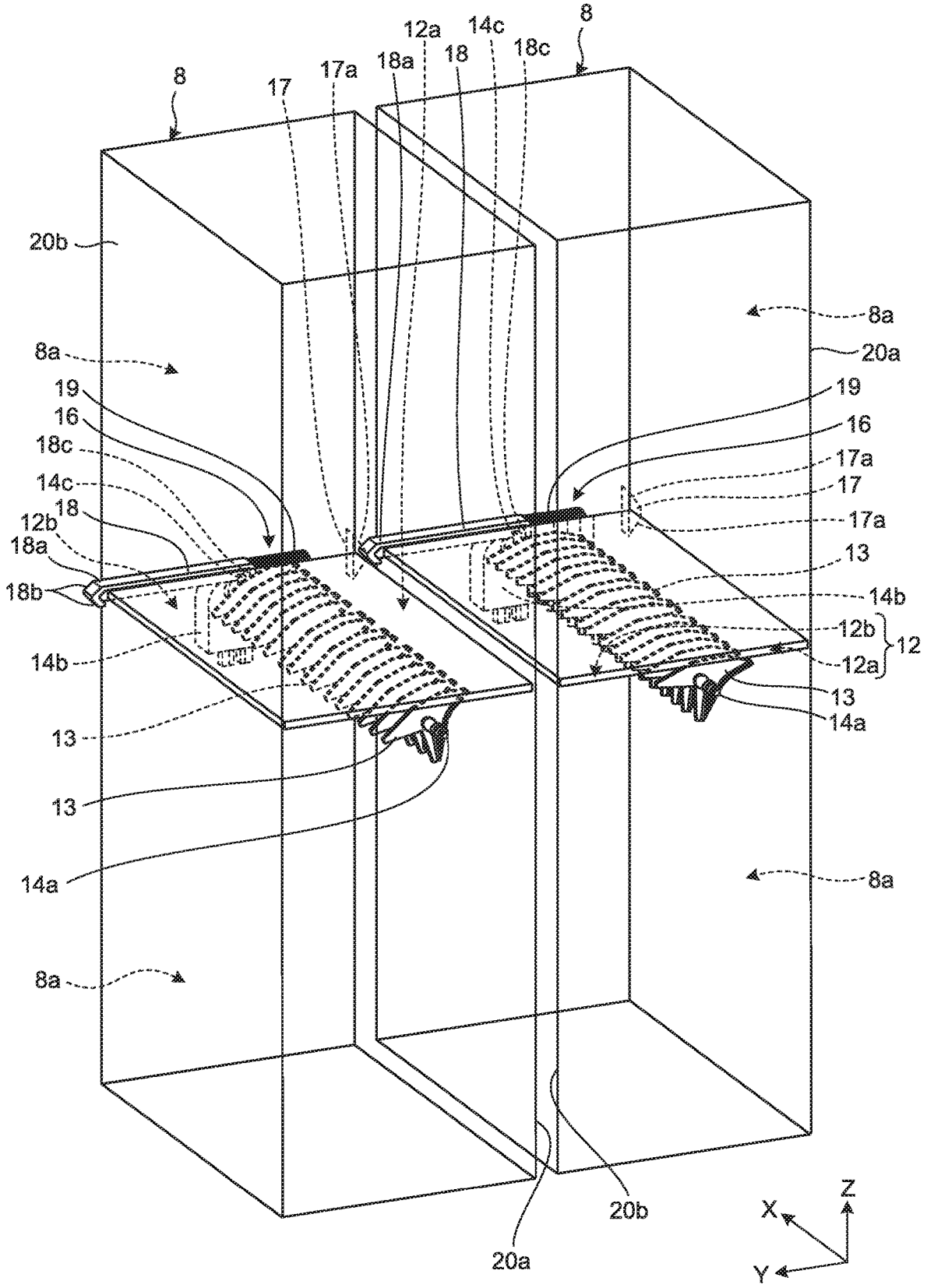
FIG. 2 is a transparent perspective view illustrating a banknote storage device of the first embodiment.
Figure 3:
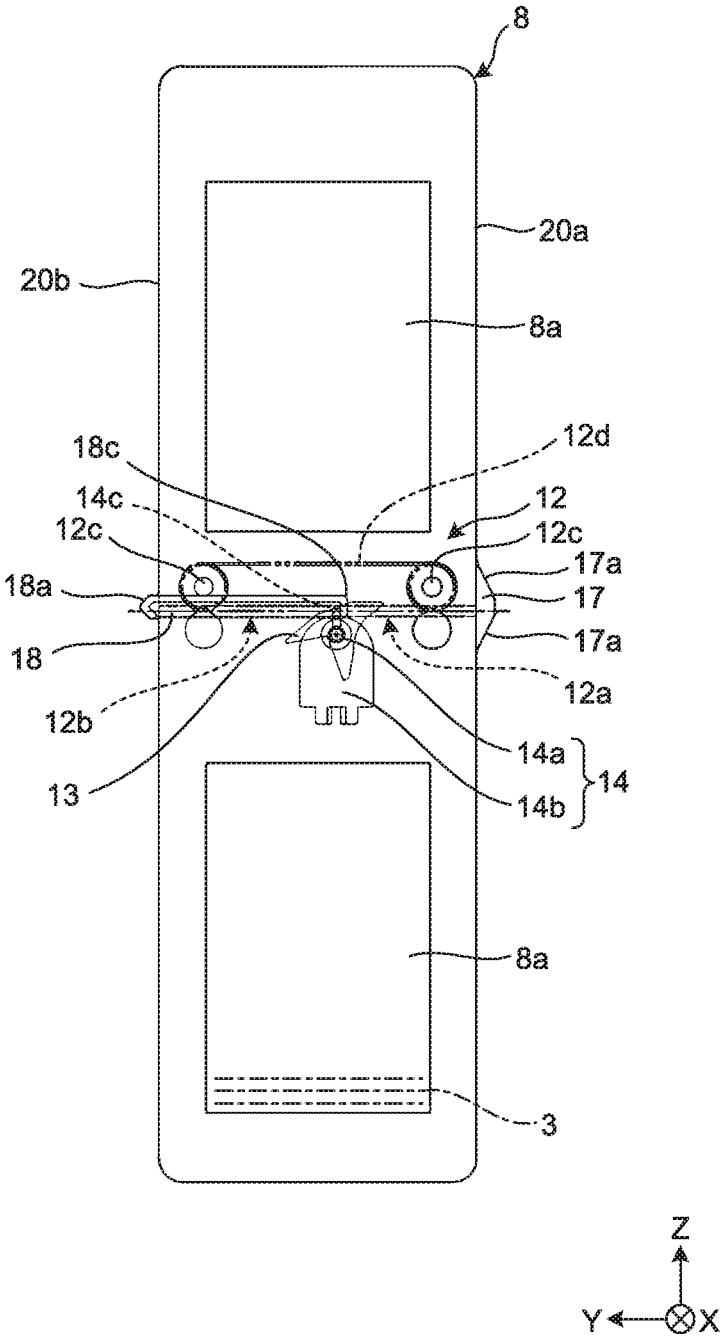
FIG. 3 is a vertical sectional view schematically illustrating the banknote storage device of the first embodiment.
Figure 4:
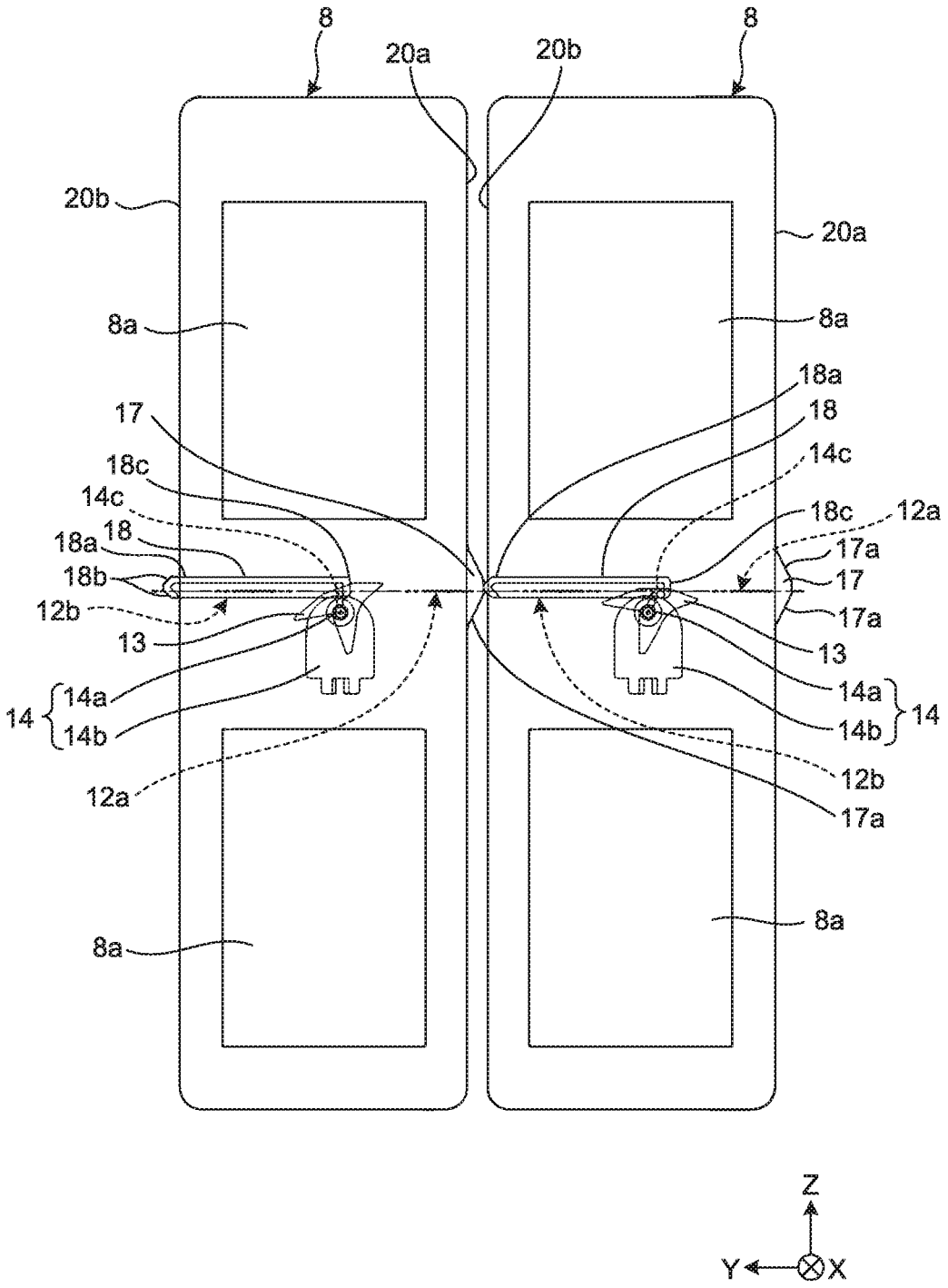
FIG. 4 is a vertical sectional view schematically illustrating a connection state of the banknote storage devices of the first embodiment.
Figure 5:
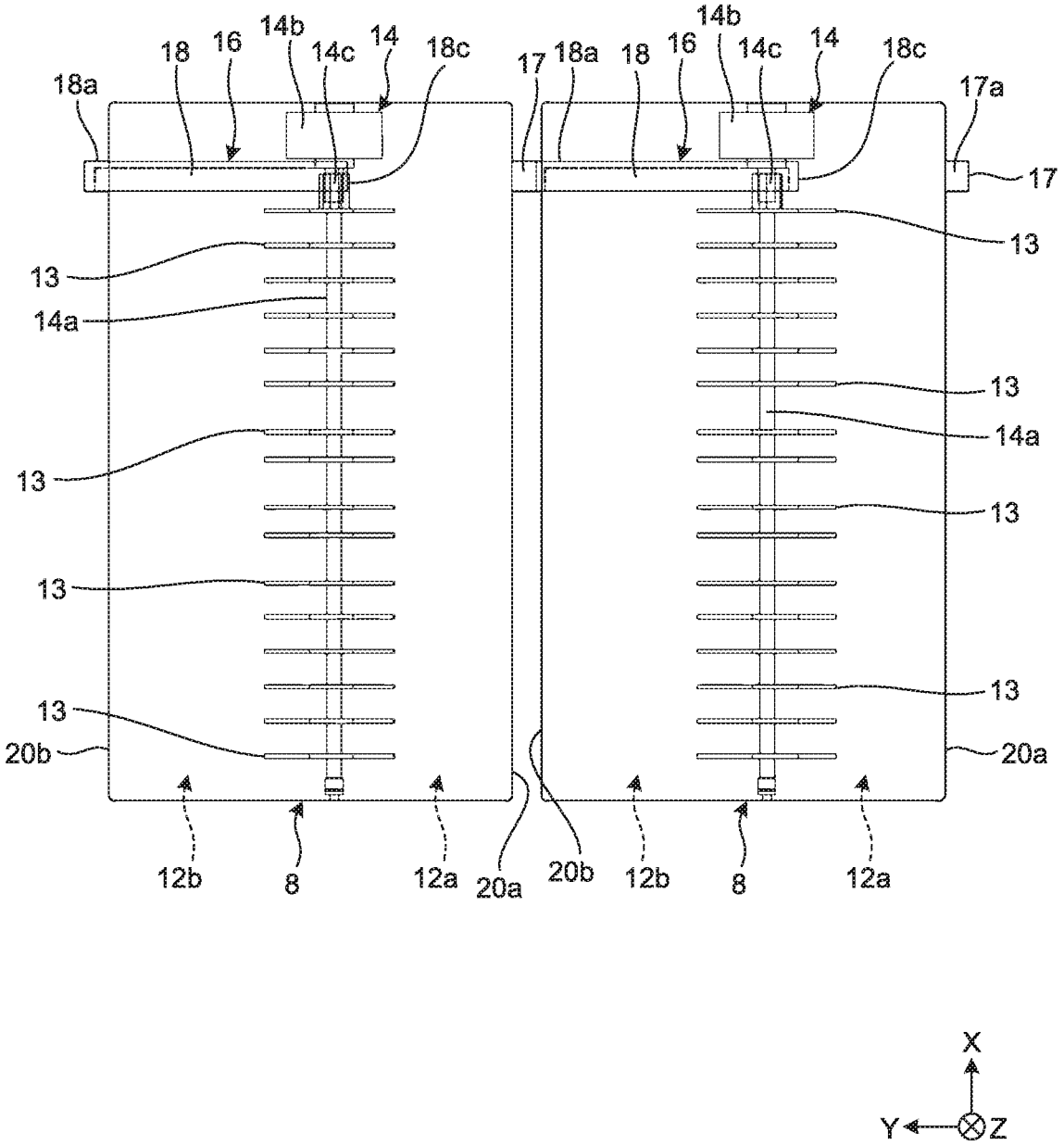
FIG. 5 is a cross-sectional view schematically illustrating the connection state of the banknote storage devices of the first embodiment.

FIG. 2 is a transparent perspective view illustrating the banknote storage device 8 of the first embodiment. FIG. 3 is a vertical sectional view schematically illustrating the banknote storage device 8 of the first embodiment. FIG. 4 is a vertical sectional view schematically illustrating a connection state of the banknote storage devices 8 of the first embodiment. FIG. 5 is a cross-sectional view schematically illustrating the connection state of the banknote storage devices 8 of the first embodiment.

As illustrated in FIG. 2, FIG. 3, and FIG. 4, the banknote storage device 8 of the first embodiment includes two storage units 8*a* storing the banknotes 3, and a conveyance mechanism 12 that conveys the banknote 3 to a lower storage unit 8*a* of the two storage units 8*a* that are arranged side by side vertically (Z direction) in FIG. 3. The conveyance mechanism 12 is connected to the conveyance mechanism 9 of the banknote handling device 1, as illustrated in FIG. 1. An upper storage unit 8*a* stores the banknote 3, which are conveyed by the conveyance mechanism 9 of the banknote handling device 1 (FIG. 1).

The conveyance mechanism 12 includes a carry-in path 12*a* for sending the banknotes 3 to the lower storage unit 8*a*, and a carry-out path 12*b* for sending the banknotes 3 from the carry-in path 12*a*. As illustrated in FIG. 3, the conveyance mechanism 12 also includes a plurality of conveyance rollers 12*c*, a conveyance belt 12*d* stretched between the conveyance rollers 12*c*, and a drive motor (not illustrated) that rotationally drives the conveyance rollers 12*c*. The carry-in path 12*a* and the carry-out path 12*b* are illustrated in a plate shape for convenience in these figures, but are configured along a conveyance surface of the conveyance belt 12*d*.

As illustrated in FIG. 4 and FIG. 5, the banknote storage device 8 includes a switching mechanism 14 having gate members 13 that can be switched between a storage state, where the banknote 3 is sent from the carry-in path 12*a* to the storage unit 8*a*, and a passing state, where the banknote 3 is sent from the carry-in path 12*a* to the carry-out path 12*b*. The switching mechanism 14 includes a rotating shaft 14*a* that supports the gate members 13, and a rotary solenoid 14*b* that rotates the rotating shaft 14*a*. The rotating shaft 14*a* includes an engagement piece 14*c* that engages with a lock member 18 of a lock mechanism 16 to be described later. The switching mechanism 14 is connected to the controller 10, and the controller 10 switches the gate member 13 between the storage state and the passing state.

The gate member 13 is disposed between the carry-in path 12*a* and the carry-out path 12*b* in the conveyance mechanism 12. As illustrated in FIG. 5, a plurality of the gate members 13 are arranged to be spaced from each other along an axial direction of the rotating shaft 14*a*. A conveyance roller 15 that conveys the banknote 3, is rotatably disposed at a position adjacent to the gate member 13 (FIG. 1).

Further, as illustrated in FIG. 3, FIG. 4, and FIG. 5, the banknote storage device 8 includes the lock mechanism 16 that locks a movement of the gate member 13, and an unlock member 17 that unlocks a locked state in the lock mechanism 16. The lock mechanism 16 includes the lock member 18 that is moved between a locked state, where the movement of the gate member 13 is restricted, and an unlocked state, where the locked state is unlocked. The lock mechanism 16 also includes a spring member 19 that biases the lock member 18 in the Y direction that the lock member 18 projects outward from the banknote storage device 8.

The lock member 18 is disposed so as to project from a side surface 20*b* of the banknote storage device 8 on a side of the carry-out path 12*b* to outside of the banknote storage device 8, and is supported by the conveyance mechanism 12 so as to be movable in the Y direction along the carry-out path 12*b*. The lock member 18 includes a distal end part 18*a* that projects outward from the side surface 20*b* of the banknote storage device 8. The distal end part 18*a* includes a pair of inclined surfaces 18*b*, which are inclined to the up-down direction (Z direction) perpendicular to the movement direction (Y direction) of the lock member 18 with respect to the movement direction. The paired inclined surfaces 18*b* are formed symmetrically with respect to the movement direction of the lock member 18, and the distal end part 18*a* is formed in a triangular shape. The lock member 18 also includes an engagement projection 18*c* that engages with the engagement piece 14*c* of the rotating shaft 14*a* in the switching mechanism 14.

The lock member 18 restricts the gate member 13 from moving from the storage state to the passing state by the engagement projection 18*c* engaging with the engagement piece 14*c* of the rotating shaft 14*a* under an biasing force of the spring member 19. That is, the lock member 18 locks the gate member 13 in the storage state, where the banknote 3 is sent into the storage unit 8*a*.

The unlock member 17 is disposed so as to project from a side surface 20*a* of the banknote storage device 8 on a side of the carry-in path 12*a* to the outside of the banknote storage device 8. The unlock member 17 is fixed to the side surface 20*a* of the banknote storage device 8. The unlock member 17 unlocks the locked state, where the lock member 18 restricts the movement of the gate member 13. When the conveyance mechanism 12 of one banknote storage device 8 and the conveyance mechanism 12 of another banknote storage device 8, which is different from the one banknote storage device 8, are connected, the lock member 18 is moved by the unlock member 17 of the another banknote storage device 8.

In addition, the unlock member 17 includes a pair of inclined surfaces 17*a* that project along the movement direction of the lock member 18 (Y direction) and are inclined to the up-down direction (Z direction) perpendicular to the movement direction with respect to the movement direction. The paired inclined surfaces 17*a* are formed symmetrically with respect to the movement direction of the lock member 18, and the unlock member 17 is formed in a triangular shape (FIG. 3). For this reason, when the banknote storage devices 8 are connected to each other, the banknote storage device 8 to be connected is, for example, lowered from above along the up-down direction (Z direction) with respect to the banknote storage device 8 connected to the banknote handling device 1. The lock member 18 is gradually pushed by the inclined surfaces 17*a* of the unlock member 17 that is lowered with respect to the distal end part 18*a* of the lock member 18 to be smoothly movable in the Y direction.

[Operation of Connecting Banknote Storage Devices]

Figure 6A:
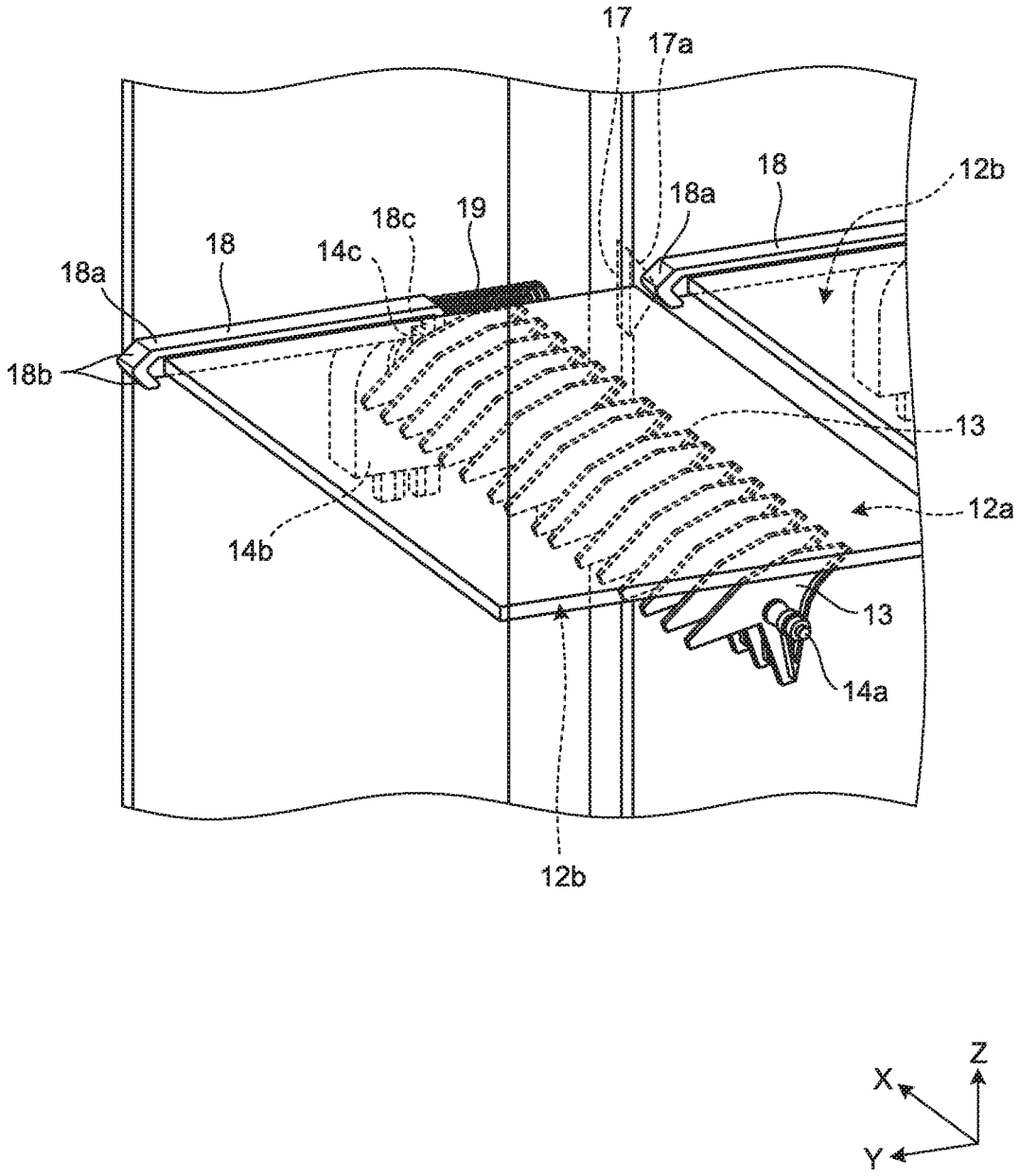
FIG. 6A is a perspective view for explaining a locked state where a lock member restricts a movement of a gate member in the banknote storage device of the first embodiment.
Figure 6B:
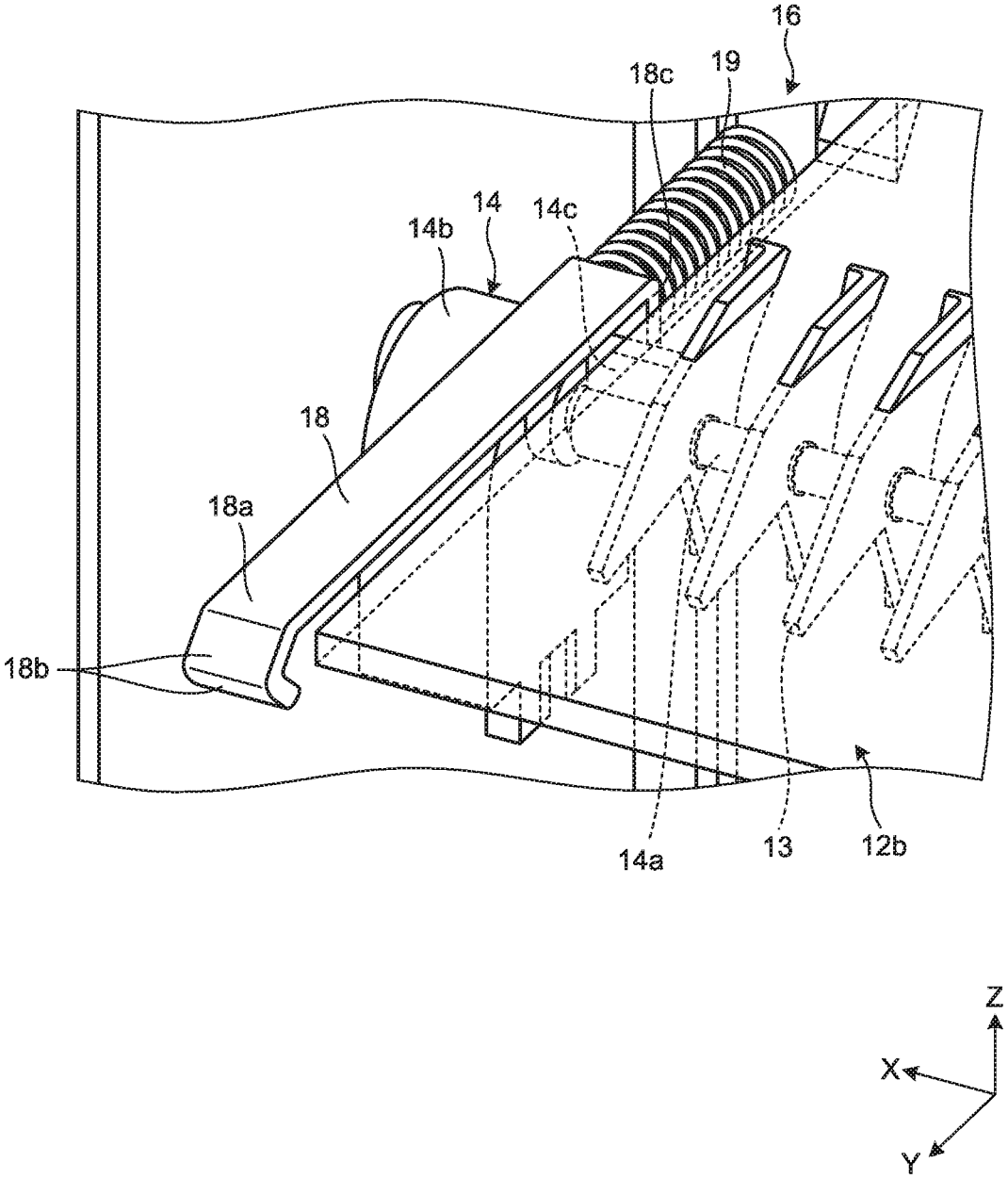
FIG. 6B is a perspective view for explaining the locked state, where the lock member restricts the movement of the gate member in the banknote storage device of the first embodiment.

Operations of the lock member 18 and the unlock member 17 when the banknote storage devices 8 configured as described above are connected to each other, will be described. FIG. 6A is a perspective view for explaining a locked state, where the lock member 18 restricts a movement of the gate member 13 in the banknote storage device 8 of the first embodiment. FIG. 6B is a perspective view for explaining the locked state, where the lock member 18 restricts the movement of the gate member 13 in the banknote storage device 8 of the first embodiment.

When the banknote storage devices 8 are connected to each other, for example, an additional banknote storage device 8 is, for example, lowered from above with respect to the banknote storage device 8, which is connected to the conveyance mechanism 9 of the banknote handling device 1, so that the banknote storage devices 8 are connected to each other via the conveyance mechanisms 12. At this time, the distal end part 18*a* of the lock member 18 in the banknote storage device 8, projects outward from the side surface 20*b* of the banknote storage device 8 on the side of the carry-out path 12*b*, as illustrated in FIG. 6A and FIG. 6B, and the engagement projection 18*c* of the lock member 18 engages with the engagement piece 14*c* of the rotating shaft 14*a* in the switching mechanism 14. For this reason, the rotating shaft 14*a* is unable to rotate by the switching mechanism 14, and the gate member 13 is locked by the lock member 18 in the storage state where the banknote 3, which is sent by the carry-in path 12*a*, is stored in the storage unit 8*a*, and thus sending the banknote 3 to the carry-out path 12*b* is mechanically restricted.

Figure 7A:
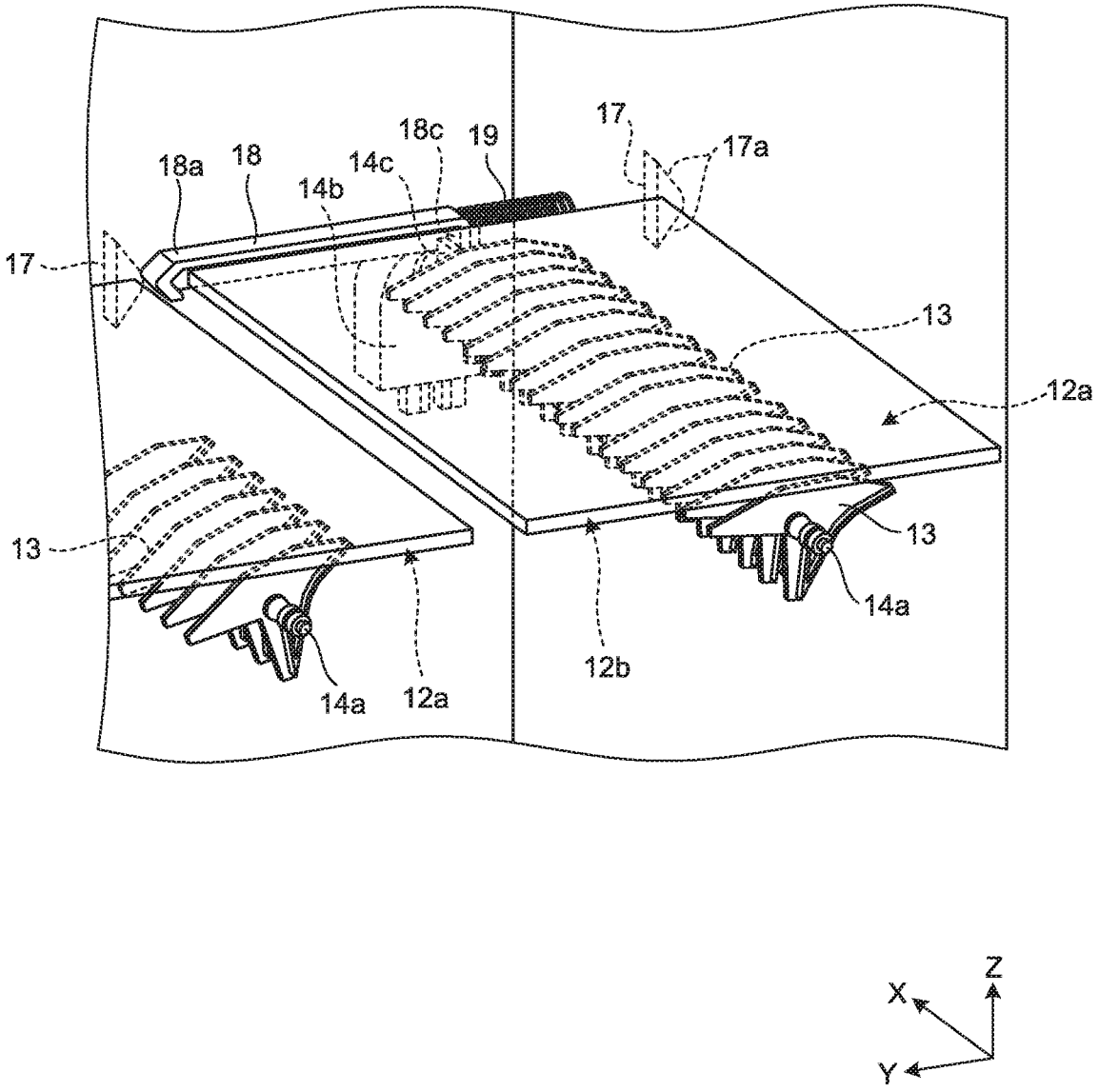
FIG. 7A is a perspective view for explaining an unlocked state, where the lock member has unlocked the locked state of the gate member in the banknote storage device of the first embodiment.
Figure 7B:
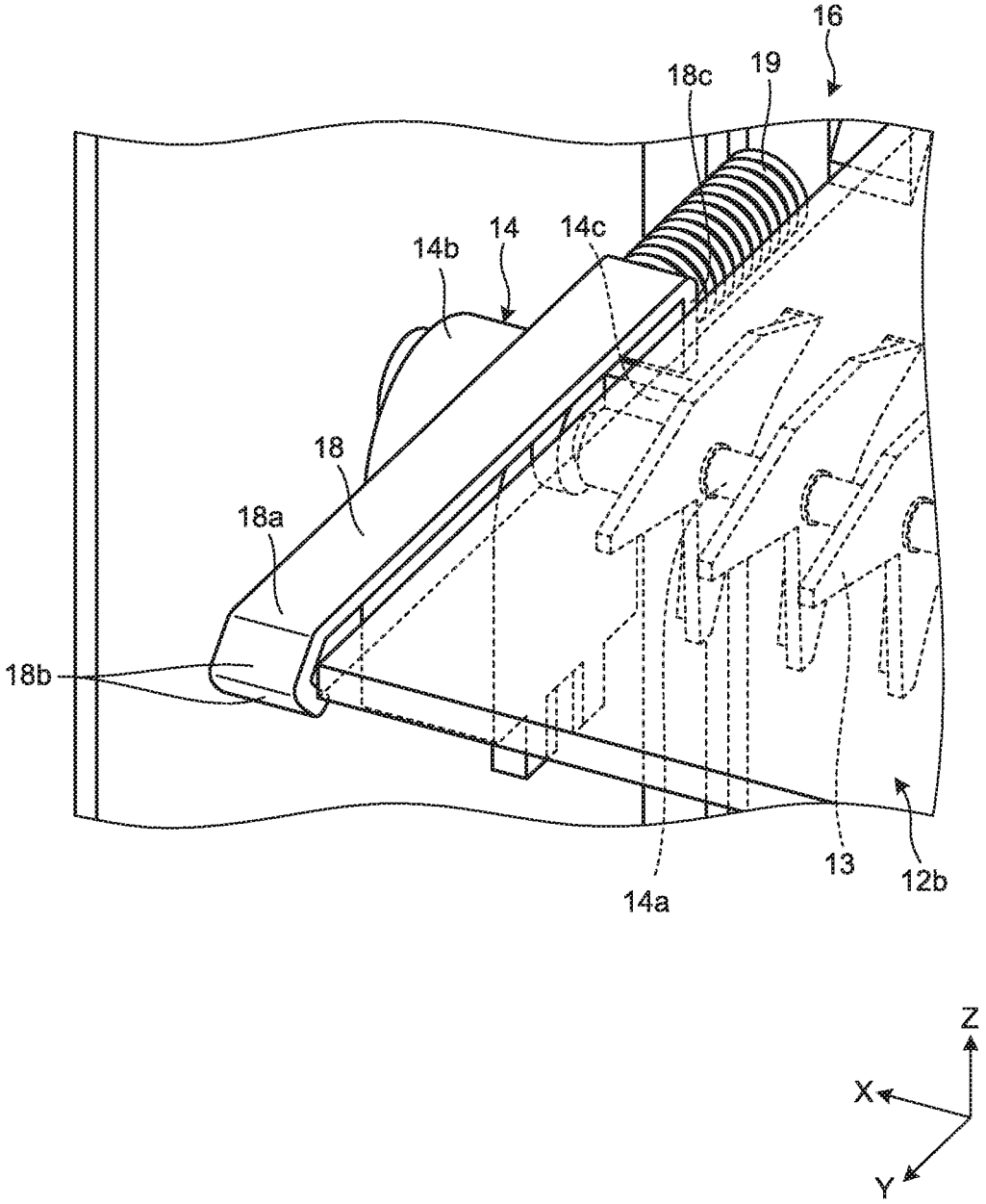
FIG. 7B is a perspective view for explaining the unlocked state, where the lock member has unlocked the locked state of the gate member in the banknote storage device of the first embodiment.

FIG. 7A is a perspective view for explaining an unlocked state, where the lock member 18 has unlocked the locked state of the gate member 13 in the banknote storage device 8 of the first embodiment. FIG. 7B is a perspective view for explaining the unlocked state, where the lock member 18 has unlocked the locked state of the gate member 13 in the banknote storage device 8 of the first embodiment.

By lowering the additional banknote storage device 8 so as to connect the side of the carry-out path 12*b* of the banknote storage device 8 from which the lock member 18 projects outward to the side of the carry-in path 12*a* of the additional banknote storage device 8 as described above, the inclined surfaces 17*a* of the unlock member 17 contact the inclined surfaces 18*b* of the distal end part 18*a* of the lock member 18. By further lowering the additional banknote storage device 8 and connecting the conveyance mechanisms 12 to each other, as illustrated in FIG. 7A and FIG. 7B, the distal end part 18*a* of the lock member 18 is pushed inside the banknote storage device 8 against an biasing force of the spring member 19 by the unlock member 17. As the distal end part 18*a* of the lock member 18 is pushed by the unlock member 17, the engagement projection 18*c* of the lock member 18 is separated from the engagement piece 14*c* of the rotating shaft 14*a* in the switching mechanism 14, so that the engagement state of the engagement projection 18*c* with the engagement piece 14*c* is unlocked. Consequently, the gate member 13 can rotate about the rotating shaft 14*a* by the switching mechanism 14 to be switched from the storage state to the passing state. As a result, the banknote storage device 8 having the additional banknote storage device 8 connected thereto, can send the banknotes 3 from the carry-out path 12*b* to the carry-in path 12*a* of the additional banknote storage device 8.

Further, in the additional banknote storage device 8 connected to the banknote storage device 8 as described above, the lock member 18 projects outward from the side surface 20*b* on the side of the carry-out path 12*b*, and the gate member 13 is locked in the storage state by the lock member 18. Consequently, in the direction of conveying the banknotes 3 between the banknote storage devices 8, the gate member 13 of the banknote storage device 8, which is located at the terminal end, is locked in the storage state, and discharging the banknote 3 from the carry-out path 12*b* is restricted. In other words, in a state where the additional banknote storage device 8 is not connected to the banknote storage device 8 at the terminal end on the side of the carry-out path 12*b*, the gate member 13 is locked in the storage state, and when the additional banknote storage device 8 is connected to the side of the carry-out path 12*b*, the gate member 13 can be switched from the storage state to the passing state.

Similarly, when the additional banknote storage device 8 is removed, in the banknote storage device 8 to which the additional banknote storage device 8 has been connected, the unlock member 17 pushing the distal end part 18*a* of the lock member 18, is separated from the distal end part 18*a*. For this reason, the lock member 18 is moved by the biasing force of the spring member 19, and thus the distal end part 18*a* projects outward from the side surface 20*b* on the side of the carry-out path 12*b*, and the engagement projection 18*c* is engaged with the engagement piece 14*c* of the rotating shaft 14*a*. As a result, the gate member 13 is restricted in the storage state by the lock member 18.

The banknote storage device 8 of the first embodiment described above includes, the lock member 18 disposed so as to project from the side of the carry-out path 12*b* to the outside of the banknote storage device 8, and the unlock member 17 disposed so as to project from the side of the carry-in path 12*a* to the outside of the banknote storage device 8. When the conveyance mechanism 12 of the banknote storage device 8 is connected to the conveyance mechanism 12 of another banknote storage device 8 that is different from the banknote storage device 8, the lock member 18 is moved by the unlock member 17 of the another banknote storage device 8. It is thus possible to prevent the gate member 13 from being moved to the passing state where the banknote 3 is discharged from the carry-out path 12*b* due to a failure of the switching mechanism 14, a malfunction of the controller 10, and the like, for example. Consequently, the reliability of the switching operation of the gate member 13 according to the connection state of the banknote storage devices 8, can be enhanced. In addition, the movement of the gate member 13 of the banknote storage device 8 at the terminal end is restricted according to an increase or decrease in the number of the banknote storage devices 8 to be connected to each other. It is thus possible to prevent the banknote 3 from being sent to the side of the carry-out path 12*b* of the banknote storage device 8 at the terminal end.

In the banknote storage device 8 of the first embodiment, the lock mechanism 16 includes the spring member 19 that biases the lock member 18 so as to project outward from the banknote storage device 8. The lock member 18 restricts the gate member 13 from being moved from the storage state to the passing state by the biasing force of the spring member 19. The lock mechanism 16 can thus restrict the gate member 13 in the storage state with a simple configuration.

In the banknote storage device 8 of the first embodiment, the unlock member 17 projects along the movement direction (Y direction) of the lock member 18, and includes a pair of inclined surfaces 17*a* which are inclined to the direction (Z direction) crossing the movement direction. The paired inclined surfaces 17*a* are formed symmetrically with respect to the movement direction of the lock member 18. Consequently, when the banknote storage devices 8 are connected to each other, the banknote storage devices 8 can be moved in both directions with respect to the Z direction, and according to the operation of connecting the banknote storage devices 8, the lock member 18 can be moved smoothly by the unlock member 17.

Moreover, in the banknote storage device 8 of the first embodiment, the distal end part 18*a* of the lock member 18 that the unlock member 17 contacts, includes a pair of inclined surfaces 18*b*, which are inclined to the direction (Z direction) crossing the movement direction (Y direction) of the lock member 18 with respect to the movement direction. The paired inclined surfaces 18*b* are formed symmetrically with respect to the movement direction of the lock member 18. The operability of the lock member 18 is enhanced by the inclined surfaces 17*a* of the unlock member 17. Consequently, when the banknote storage devices 8 are connected to each other, the lock member 18 can be moved further smoothly by the unlock member 17 according to the operation of connecting the banknote storage devices 8.

In the first embodiment, the distal end part 18*a* of the lock member 18 is disposed so as to project from the side surface 20*b* of the banknote storage device 8 on the side of the carry-out path 12*b* to the outside of the banknote storage device 8, and the unlock member 17 is disposed so as to project from the side surface 20*a* of the banknote storage device 8 on the side of the carry-in path 12*a* to the outside of the banknote storage device 8. However, the lock member 18 and the unlock member 17 may be disposed reversely with respect to the carry-in path 12*a* and the carry-out path 12*b*. That is, the lock member 18 may be projected from the side surface 20*a* of the banknote storage device 8 on the side of the carry-in path 12*a* to the outside of the banknote storage device 8, and the unlock member 17 may be projected from the side surface 20*b* of the banknote storage device 8 on the side of the carry-out path 12*b* to the outside of the banknote storage device 8, which achieves a similar effect to that of the first embodiment.

In addition, the inclined surface 17*a* of the unlock member 17 in the first embodiment, is configured to be inclined to the up-down direction (Z direction) with respect to the movement direction (Y direction) of the lock member 18 so that the banknote storage devices 8 slide in the up-down direction to be connected to each other, but the present invention is not limited to this configuration. The inclined surface 17*a* of the unlock member 17 may be configured to be inclined to the horizontal direction (X direction) with respect to the movement direction (Y direction) of the lock member 18 so that the banknote storage devices 8 slide in the horizontal direction (X direction) to be connected to each other. Similarly, the inclined surface 18*b* of the distal end part 18*a* of the lock member 18 is not limited to the configuration, in which the inclined surface 18*b* is inclined to the up-down direction (Z direction) with respect to the movement direction (Y direction) of the lock member 18, and the inclined surface 18*b* may be inclined in the horizontal direction (X direction) with respect to the movement direction (Y direction) of the lock member 18.

In addition, the lock member 18 of the first embodiment is disposed so as to slide in the Y direction. However, for example, the lock member 18 may be disposed so as to be rotatable about a rotating shaft (not illustrated), and may be configured to move between a locked state, where the gate member 13 is locked, and an unlocked state, where the locked state is unlocked, according to the rotation of the lock member 18.

Hereinafter, other embodiments will be described with reference to the drawings. In other embodiments, the same components as those in the first embodiment are denoted by the same reference numerals as those in the first embodiment, and description thereof will be omitted.

Second Embodiment

Figure 8:
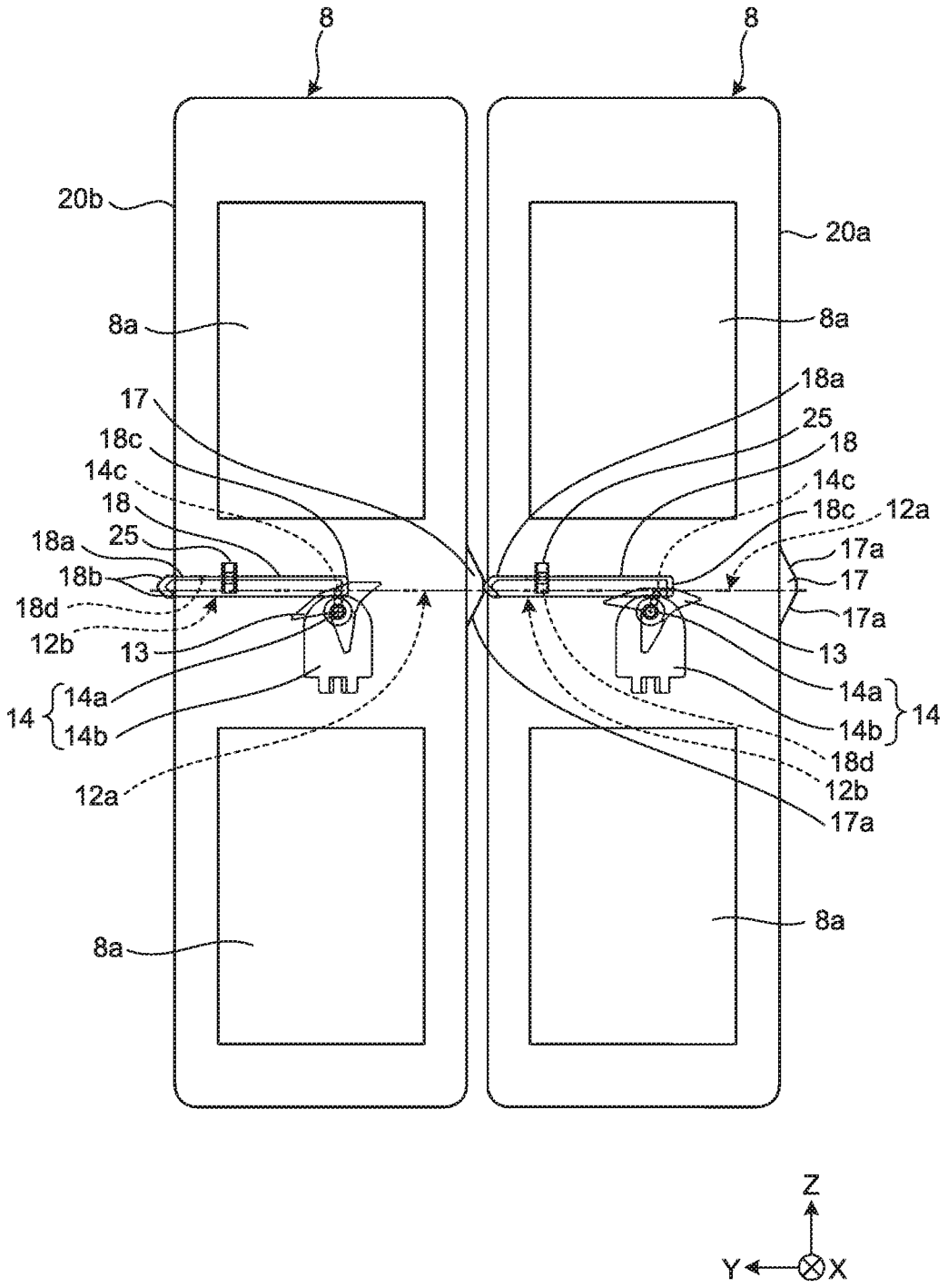
FIG. 8 is a vertical sectional view schematically illustrating a connection state of banknote storage devices of a second embodiment.
Figure 9:
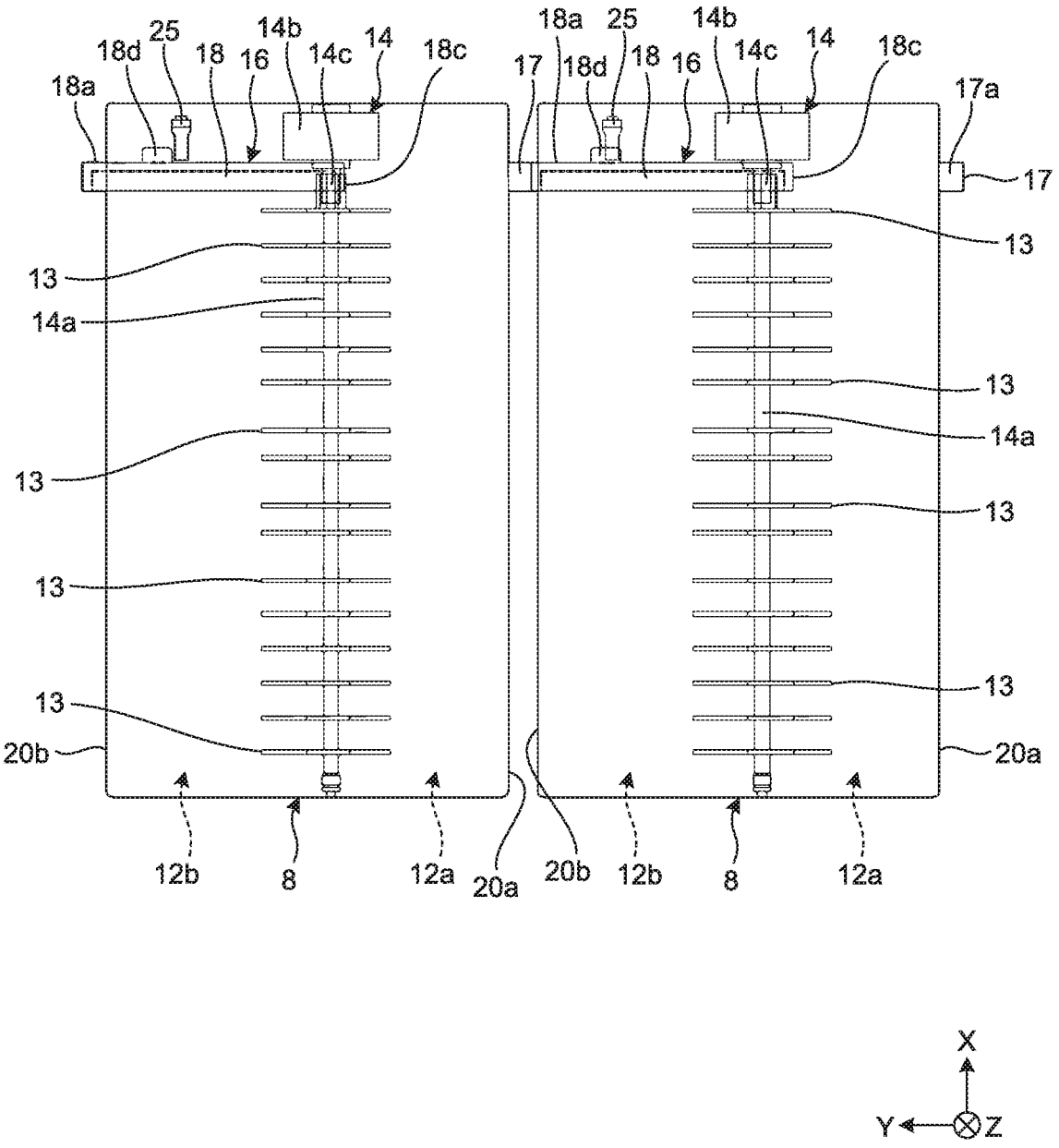
FIG. 9 is a cross-sectional view schematically illustrating the connection state of the banknote storage devices of the second embodiment.

FIG. 8 is a vertical sectional view schematically illustrating a connection state of banknote storage devices 8 of a second embodiment. FIG. 9 is a cross-sectional view schematically illustrating the connection state of the banknote storage devices 8 of the second embodiment. The second embodiment differs from the first embodiment in that the movement of the lock member 18 is detected by a position sensor.

As illustrated in FIG. 8 and FIG. 9, the banknote storage device 8 of the second embodiment includes a position sensor 25 that detects a movement of the lock member 18.

An optical sensor is used as the position sensor 25, and although not illustrated, the position sensor 25 includes a light emitting unit that emits detection light, and a light receiving unit that receives the detection light emitted by the light emitting unit. The position sensor 25 is disposed on the carry-out path 12*b*, and is connected to the controller 10. Based on a detection result of the position sensor 25, the controller 10 controls the gate member 13 to be switched between a storage state and a passing state.

As illustrated in FIG. 8 and FIG. 9, the lock member 18 includes a detection piece 18*d* for detecting the movement of the lock member 18 by the position sensor 25. The detection piece 18*d* is disposed so as to be separated from the position sensor 25 in a locked state, where the distal end part 18*a* of the lock member 18 projects outward from the banknote storage device 8, and so as to face the position sensor 25 in an unlocked state, where the lock member 18 is moved by the unlock member 17.

When the lock member 18 is pushed by the unlock member 17, the detection piece 18*d* of the position sensor 25 moves with the movement of the lock member 18. The detection piece 18*d* thus moved enters between the light receiving unit and the light emitting unit in the position sensor 25, and blocks the detection light of the position sensor 25, so that the position sensor 25 detects the movement of the lock member 18. When the detection light of the position sensor 25 is blocked by the lock member 18, the controller 10 appropriately switches the gate member 13 between the storage state and the passing state by the switching mechanism 14. Further, when the detection light of the position sensor 25 is not blocked by the lock member 18, the controller 10 does not drive the switching mechanism 14 and does not move the gate member 13 in the storage state.

[Control Method of Banknote Storage Device]

Figure 10:
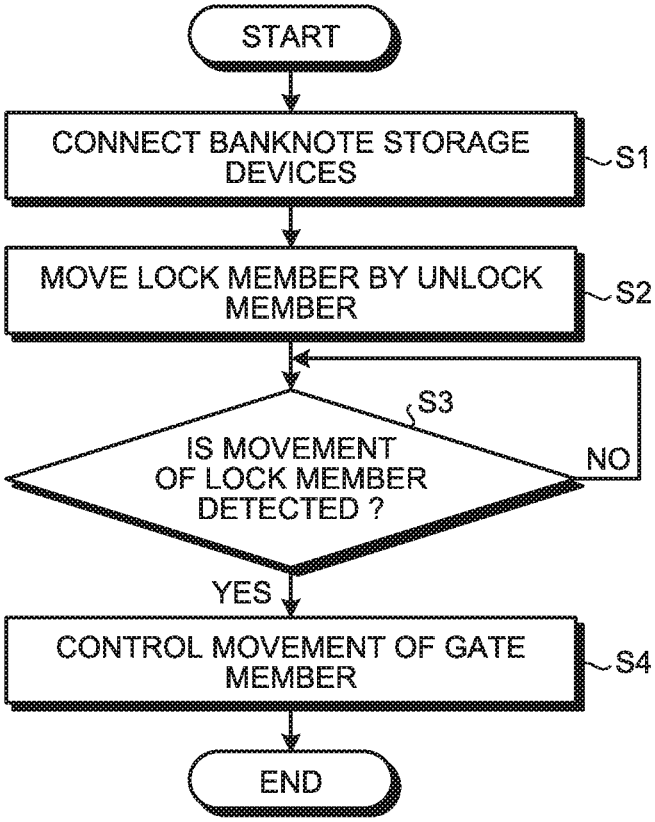
FIG. 10 is a flowchart for explaining a control method of the banknote storage device of the second embodiment.

A control method of the banknote storage device 8 according to the second embodiment described above, will be described. FIG. 10 is a flowchart for explaining the control method of the banknote storage device 8 of the second embodiment. As illustrated in FIG. 10, in the banknote storage device 8, the conveyance mechanism 12 and the conveyance mechanism 12 of another banknote storage device 8, which is different from the banknote storage device 8, are connected to each other (step S1). At this time, the lock member 18 of the banknote storage device 8 is pushed and moved by the unlock member 17 of the another banknote storage device 8 (step S2), and the controller 10 determines whether or not the lock member 18 is moved based on a detection result of the position sensor 25 (step S3).

When the controller 10 determines at step S3 that the lock member 18 is not moved (No), the process returns to step S3 again, and the position sensor 25 continues to detect the movement of the lock member 18. When the lock member 18 is properly moved by properly connecting the banknote storage devices 8 via the respective conveyance mechanisms 12, the position sensor 25 detects the movement of the lock member 18, and based on the detection result of the position sensor 25, the controller 10 determines that lock member 18 is moved (YES at step S3). The controller 10 controls the gate member 13 to move between the storage state and the passing state based on the detection result of the position sensor 25 (step S4).

As described above, the banknote storage device 8 of the second embodiment includes the position sensor 25 that detects the movement of the lock member 18. Consequently, the controller 10 can control the switching operation of the gate member 13 based on the detection result of the position sensor 25. The reliability of the switching operation of the gate member 13, can thus be further enhanced. Also in the second embodiment, the lock member 18 and the position sensor 25 may be disposed on the side of the carry-in path 12*a* of the banknote storage device 8.

Third Embodiment

Figure 11:
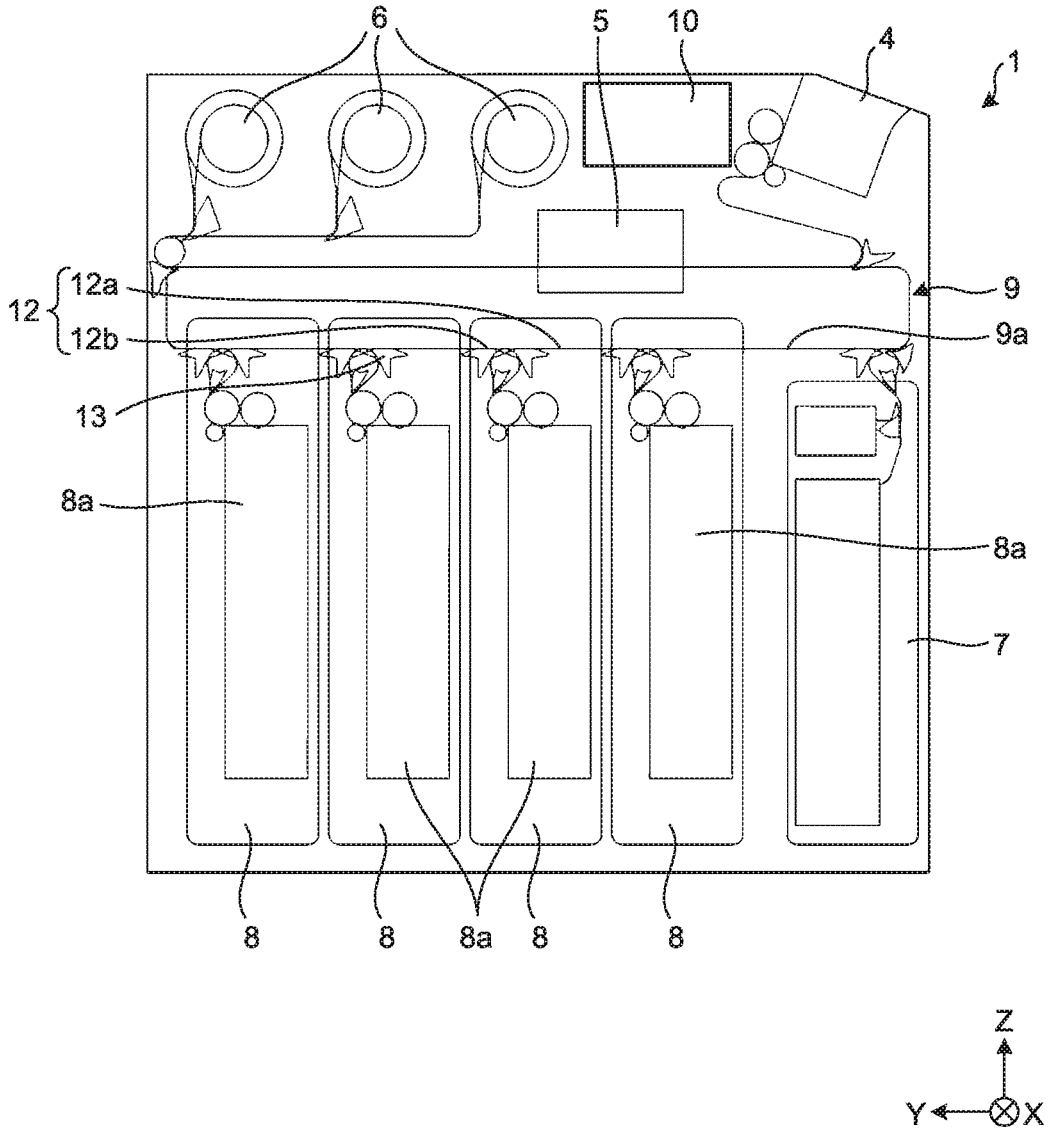
FIG. 11 is a schematic view illustrating an entire banknote handling device of a third embodiment.

FIG. 11 is a schematic view illustrating another example of an entire banknote handling device of a third embodiment. The third embodiment illustrated in FIG. 11 differs from the first embodiment illustrated in FIG. 1 in configurations of the storage unit 8*a* and the conveyance mechanism 12. As illustrated in FIG. 11, the banknote storage device 8 of the third embodiment includes one storage unit 8*a*, and the conveyance mechanism 12, which conveys the banknote 3 to the storage unit 8*a*, is connected to the conveyance mechanism 9 of the banknote handling device 1. Configurations of the gate member 13, the unlock member 17, the lock member 18, and the like in the third embodiment, are similar to those in the first embodiment, and thus description thereof is omitted.

As illustrated in FIG. 11, in the banknote storage device 8 of the third embodiment, for example, the carry-out path 12*b* of the banknote storage device 8, which is disposed at the terminal end in a direction of conveying the banknote 3 between a plurality of the banknote storage devices 8, is connected to the conveyance path 9*a* of the conveyance mechanism 9 in the banknote handling device 1. The present invention is not limited to this configuration, and the carry-out path 12*b* of the banknote storage device 8, which is disposed at the terminal end, may be opened without being connected to the conveyance path 9*a*.

In the first, second, and third embodiments described above, the banknote storage devices 8 are arranged so as to be connected along the horizontal direction (Y direction), but the present invention is not limited to this configuration. The plurality of banknote storage devices 8 may be arranged so as to be stacked in the up-down direction (Z direction).

According to one aspect of the paper sheet storage device disclosed in the present application, the reliability of the switching operation of the gate member according to the connection state of the paper sheet storage devices, can be enhanced.

All examples and conditional language provided herein are intended for the pedagogical purposes of aiding the reader in understanding the invention and the concepts contributed by the inventor to further the art, and are not to be construed as limitations to such specifically recited examples and conditions, nor does the organization of such examples in the specification relate to a showing of the superiority and inferiority of the invention. Although one or more embodiments of the present invention have been described in detail, it should be understood that the various changes, substitutions, and alterations could be made hereto without departing from the spirit and scope of the invention.

What is claimed is:

1. A paper sheet storage device comprising:

a storage unit that stores a paper sheet;

a conveyance mechanism that includes a carry-in path for sending a paper sheet to the storage unit and a carry-out path for sending a paper sheet from the carry-in path;

a gate member that is disposed in the conveyance mechanism and is switched between a storage state, where a paper sheet is sent from the carry-in path to the storage unit, and a passing state, where a paper sheet is sent from the carry-in path to the carry-out path;

a lock mechanism that includes a lock member which is moved between a locked state, where a movement of the gate member is restricted, and an unlocked state, where the locked state is unlocked; and an unlock member that unlocks a locked state, where the lock member restricts a movement of the gate member, wherein the unlock member is disposed so as to project from a side of one of the carry-in path and the carry-out path to outside of the paper sheet storage device, the lock member is disposed so as to project from a side of an other of the carry-in path and the carry-out path to the outside of the paper sheet storage device, and when the conveyance mechanism of the paper sheet storage device is connected to the conveyance mechanism of another paper sheet storage device that is different from the paper sheet storage device, the lock member is moved by the unlock member of the another paper sheet storage device.

2. The paper sheet storage device according to claim 1, wherein the lock mechanism includes a spring member that biases the lock member so as to project outward from the paper sheet storage device, and the lock member restricts the gate member from being moved from the storage state to the passing state by an biasing force of the spring member.

3. The paper sheet storage device according to claim 1, wherein the unlock member projects along a movement direction of the lock member, and includes paired inclined surfaces, which are inclined to a direction crossing the movement direction with respect to the movement direction, and the paired inclined surfaces are formed symmetrically with respect to the movement direction.

4. The paper sheet storage device according to claim 3, wherein a distal end part of the lock member that the unlock member contacts, includes paired inclined surfaces, which are inclined to a direction crossing the movement direction of the lock member with respect to the movement direction, and the paired inclined surfaces are formed symmetrically with respect to the movement direction.

5. The paper sheet storage device according to claim 1 further comprising:

a controller that is configured to control a movement of the gate member; and a position sensor that detects a movement of the lock member, wherein the controller controls the gate member to move to the storage state and the passing state based on a detection result of the position sensor.

6. A control method of a paper sheet storage device, the paper sheet storage device including a conveyance mechanism that includes a carry-in path for sending a paper sheet to a storage unit storing a paper sheet and a carry-out path for sending a paper sheet from the carry-in path, a gate member that is switched between a storage state, where a paper sheet is sent from the carry-in path to the storage unit, and a passing state, where a paper sheet is sent from the carry-in path to the carry-out path, a lock mechanism that includes a lock member that restricts a movement of the gate member, an unlock member that unlocks a locked state, where the lock member restricts a movement of the gate member, a controller that is configured to control a movement of the gate member, and a position sensor that detects a movement of the lock member, the control method comprising:

detecting that the lock member of the paper sheet storage device is moved by the unlock member of the another paper sheet storage device, by the position sensor, when the conveyance mechanism of the paper sheet storage device is connected to the conveyance mechanism of another paper sheet storage device that is different from the paper sheet storage device; and controlling the gate member to move to the storage state and the passing state based on a detection result of the position sensor, by the controller.

* * * * *